US006241568B1

(12) United States Patent
Simms

(10) Patent No.: US 6,241,568 B1
(45) Date of Patent: Jun. 5, 2001

(54) TRAVEL SURFBOARD

(76) Inventor: Robert A. Simms, P.O. Box 1725, Kamuela, HI (US) 96743

( * ) Notice: Subject to any disclaimer, the term of this patent is extended or adjusted under 35 U.S.C. 154(b) by 0 days.

(21) Appl. No.: 09/466,082

(22) Filed: Dec. 17, 1999

(51) Int. Cl.[7] ..... B63B 35/79
(52) U.S. Cl. ..... 441/74; 441/66; 441/79
(58) Field of Search ..... 441/74, 66, 79, 441/75

(56) References Cited

U.S. PATENT DOCUMENTS

| | | | | |
|---|---|---|---|---|
| D. 392,710 | | 3/1998 | Del Paso . | |
| 2,013,410 | | 9/1935 | Howland . | |
| 2,404,729 | | 7/1946 | Hurt . | |
| 3,455,571 | | 7/1969 | Dallera et al. . | |
| 3,577,576 | * | 5/1971 | Lobb et al. . | |
| 3,657,753 | * | 4/1972 | Blanc, Sr. . | |
| 3,659,300 | * | 5/1972 | Johnson | 441/79 |
| 4,804,347 | * | 2/1989 | Ross | 441/79 |
| 4,894,033 | | 1/1990 | Chang . | |
| 5,122,086 | | 6/1992 | Remy . | |
| 5,779,510 | * | 7/1998 | Skedelski | 441/75 |

FOREIGN PATENT DOCUMENTS 31 43 769 * 5/1983 (DE) .

* cited by examiner

*Primary Examiner*—Sherman Basinger

(57) ABSTRACT

A collapsible surfboard for making it easy for a user to conveniently travel with a surfboard. The collapsible surfboard includes an elongate inflatable bladder adapted for holding a quantity of air in an interior of the bladder. The elongate inflatable bladder has a shape generally corresponding to a surfboard. The elongate inflatable bladder has a front end, a rear end, and a pair of side edges extending between the front and rear ends. The inflatable bladder has a top surface and a bottom surface, and the inflatable bladder has an elongate pocket extending along a longitudinal axis of the bladder between the front and rear ends. An elongate beam is provided for stiffening the inflatable bladder when inflated. The elongate beam is removably insertable in the elongate pocket of the inflatable bladder.

16 Claims, 2 Drawing Sheets

TRAVEL SURFBOARD

BACKGROUND OF THE INVENTION

1. Field of the Invention

The present invention relates to easily portable surfboards and more particularly pertains to a new collapsible surfboard for making it easy for a user to conveniently collapsible with a surfboard.

2. Description of the Prior Art

The use of easily portable surfboards is known in the prior art. More specifically, easily portable surfboards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,455,571; U.S. Pat. No. 4,894,033; U.S. Pat. No. 5,122,086; U.S. Pat. No. 2,404,729; U.S. Pat. No. 2,013,410; and U.S. Pat. No. DES. 392,710.

While these devices fulfill their respective, particular objectives and requirements, the aforementioned patents do not disclose a new collapsible surfboard. The inventive device includes an elongate inflatable bladder adapted for holding a quantity of air in an interior of the bladder. The elongate inflatable bladder has a shape generally corresponding to a surfboard. The elongate inflatable bladder has a front end, a rear end, and a pair of side edges extending between the front and rear ends. The inflatable bladder has a top surface and a bottom surface, and the inflatable bladder has an elongate pocket extending along a longitudinal axis of the bladder between the front and rear ends. An elongate beam is provided for stiffening the inflatable bladder when inflated. The elongate beam is removably insertable in the elongate pocket of the inflatable bladder.

In these respects, the collapsible surfboard according to the present invention substantially departs from the conventional concepts and designs of the prior art, and in so doing provides an apparatus primarily developed for the purpose of making it easy for a user to conveniently travel with a surfboard.

SUMMARY OF THE INVENTION

In view of the foregoing disadvantages inherent in the known types of easily portable surfboards now present in the prior art, the present invention provides a new collapsible surfboard construction wherein the same can be utilized for making it easy for a user to conveniently travel with a surfboard.

The general purpose of the present invention, which will be described subsequently in greater detail, is to provide a new collapsible surfboard apparatus which has many of the advantages of the portable surfboards mentioned heretofore and many novel features that result in a new collapsible surfboard which is not anticipated, rendered obvious, suggested, or even implied by any of the prior art portable surfboards, either alone or in any combination thereof.

To attain this, the present invention generally comprises an elongate inflatable bladder adapted for holding a quantity of air in an interior of the bladder. The elongate inflatable bladder has a shape generally corresponding to a surfboard. The elongate inflatable bladder has a front end, a rear end, and a pair of side edges extending between the front and rear ends. The inflatable bladder has a top surface and a bottom surface, and the inflatable bladder has an elongate pocket extending along a longitudinal axis of the bladder between the front and rear ends. An elongate beam is provided for stiffening the inflatable bladder when inflated. The elongate beam is removably insertable in the elongate pocket of the inflatable bladder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible surfboard apparatus and method which has many of the advantages of the portable surfboards mentioned heretofore and many novel features that result in a new collapsible surfboard which is not anticipated, rendered obvious, suggested, or even implied by any of the prior art portable surfboards, either alone or in any combination thereof.

It is another object of the present invention to provide a new collapsible surfboard which may be easily and efficiently manufactured and marketed.

It is a further object of the present invention to provide a new collapsible surfboard which is of a durable and reliable construction.

An even further object of the present invention is to provide a new collapsible surfboard which is susceptible of a low cost of manufacture with regard to both materials and labor, and which accordingly is then susceptible of low prices of sale to the consuming public, thereby making such collapsible surfboard economically available to the buying public.

Still yet another object of the present invention is to provide a new collapsible surfboard which provides in the apparatuses and methods of the prior art some of the advantages thereof, while simultaneously overcoming some of the disadvantages normally associated therewith.

Still another object of the present invention is to provide a new collapsible surfboard for making it easy for a user to conveniently travel with a surfboard.

Yet another object of the present invention is to provide a new collapsible surfboard which includes an elongate inflatable bladder adapted for holding a quantity of air in an interior of the bladder. The elongate inflatable bladder has a shape generally corresponding to a surfboard. The elongate inflatable bladder has a front end, a rear end, and a pair of side edges extending between the front and rear ends. The inflatable bladder has a top surface and a bottom surface, and the inflatable bladder has an elongate pocket extending along a longitudinal axis of the bladder between the front and rear ends. An elongate beam is provided for stiffening the inflatable bladder when inflated. The elongate beam is removably insertable in the elongate pocket of the inflatable bladder.

Still yet another object of the present invention is to provide a new collapsible surfboard that traveling with a surfboard will be made very easy and convenient due to the ability to collapse the surfboard to a small compact size convenient for travel.

Even still another object of the present invention is to provide a new collapsible surfboard is easily shippable, maybe carried in easily toted bags when traveling with the collapsible surfboard. The surfboard may be conveniently carried in conventional luggage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
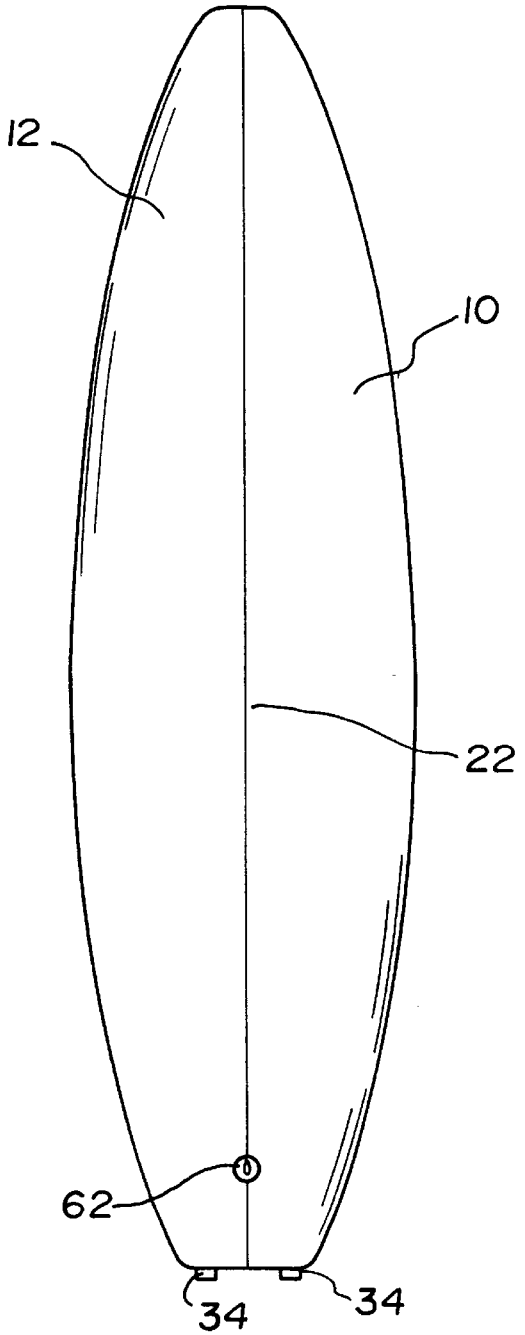
FIG. 1 is a top view of a new collapsible surfboard according to the present invention.
Figure 2B:
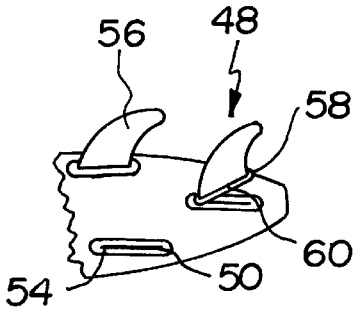
FIG. 2*b* is a partial bottom view of the present invention.
Figure 2A:
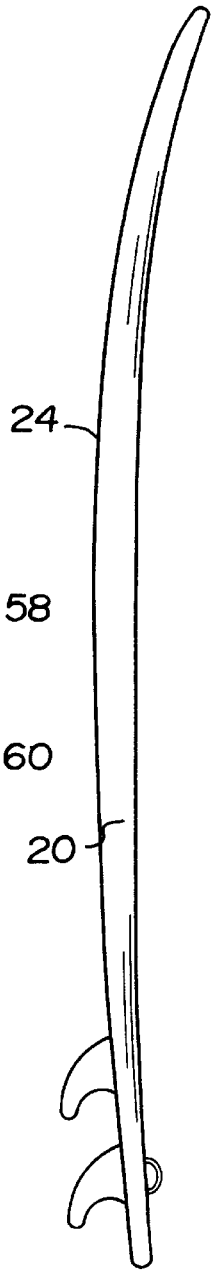
FIG. 2*a* is a side view of the present invention.
Figure 3:
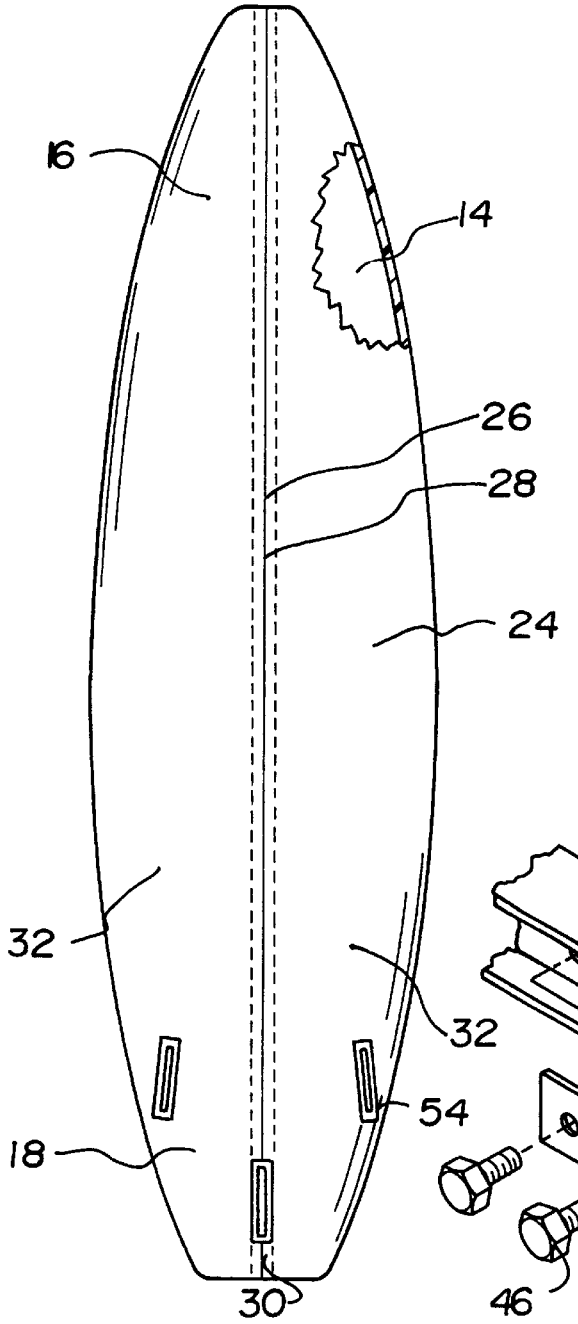
FIG. 3 is a bottom partial sectional view of the present invention.
Figure 5:
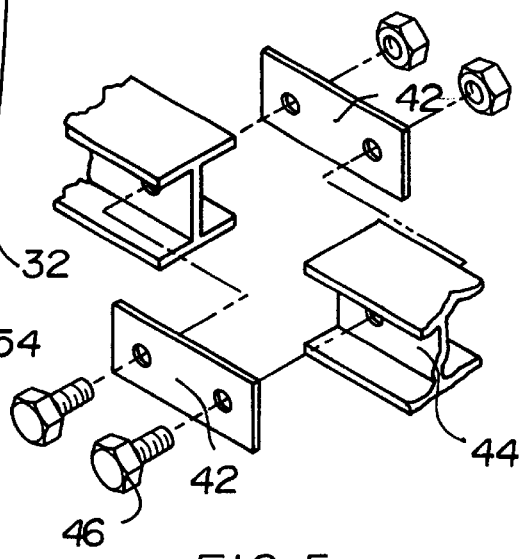
FIG. 5 is a partial exploded view of the support beam connector assembly of the present invention.
Figure 4:
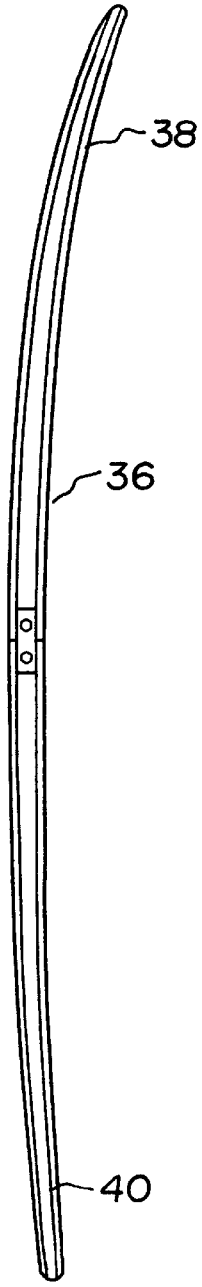
FIG. 4 is a side view of the support beam of the present invention.

With reference now to the drawings, and in particular to FIGS. 1 through 5 thereof, a new collapsible surfboard embodying the principles and concepts of the present invention and generally designated by the reference numeral 10 will be described.

As best illustrated in FIGS. 1 through 5, the collapsible surfboard 10 generally includes an elongate inflatable bladder 12 designed for holding a quantity of air in an interior 14 of the bladder 12. The elongate inflatable bladder 12 has a shape generally corresponding to a conventional surfboard. The elongate inflatable bladder 12 includes a front end 16, a rear end 18, and a pair of side edges 20 extending between the front 16 and rear 18 ends. The inflatable bladder 12 includes a top surface 22 and a bottom surface 24. The inflatable bladder 12 includes an elongate pocket 26 extending along a longitudinal axis of the bladder 12 between the front 16 and rear 18 ends. The pocket 26 divides the bladder 12 into two sides of substantially equal size, a slit 28 is formed in the bottom surface 24 of the inflatable bladder 12 and opening 30 into the elongate pocket 26. The elongate pocket 26 preferably divides the interior 14 of the inflatable bladder 12 into two individual chambers 32. Each chamber 32 is designed to hold air separately from the other chamber and is not in communication with the other of the chambers 32. The inflatable bladder 12 includes an air valve 34 in communication with the interior 14 of the inflatable bladder 12. The air valve 34 is located on the rear end 18 of the inflatable bladder 12. The bladder 12 includes an air valve 34 in communication with each of the chambers 32. The two air valves 34 are positioned at laterally spaced locations on the rear end 18 of the inflatable bladder 12.

An elongate beam 36 is provided for stiffening the inflatable bladder 12 when inflated. The elongate beam 36 is removably insertable in the elongate pocket 26 of the inflatable bladder 12. The beam 36 has an arcuate shape for creating a concave curve in the top surface 22 of the inflatable bladder 12 when the beam 36 is inserted in the pocket 26 of the bladder 12. The pocket 26 is designed to close the slit 28 upon inflation of the chambers 32 of the inflatable bladder 12 with the beam 36 held in the pocket 26. The elongate beam 36 includes front 38 and rear 40 elongate portions that are connectable in an end-to-end arrangement for insertion into the pocket 30 of the inflatable bladder 12 and are disconnectable for facilitating transport and storage of the beam 36 when the bladder 12 is not in use. The portions of the beam 36 are connectable by a pair of support plates 42. Each of the support plates 42 are attachable to a side 44 of the beam portions 38, 40 opposite of the side of the other of the support plates 42. A fastener 46 is provided for passing through one of the support plates 42, and an end of one of the beam portions 38. The other of the support plates 42 is positioned such that the beam portions 44 are sandwiched between the support plates 42. The beam 36 may have an I-shape, and preferably comprises aluminum.

At least one fin assembly 48 is preferably provided on the bladder. Each fin assembly 48 comprises a fin mount 50 formed in the bottom surface 24 of the inflatable bladder. The fin mount 50 includes a slot 54. The fin assembly 48 includes a fin 56 releasably insertable in the slot 54 of the fin mount 50. Three fin assemblies 48 may be mounted on the bottom surface 24 of the inflatable bladder 12. Each of the fins 56 includes an insertion portion 58 for insertion into the slot 54 of the fin mount 50. The insertion portion 58 includes a flange 60 thereon for removably lodging in the slot 54 of the fin mount 50. A leash attachment grommet 62 may be mounted on the top surface 22 of the inflatable bladder 12 for receiving a cord or leash.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible surfboard system, comprising:

an elongate inflatable bladder adapted for holding a quantity of air in an interior of the bladder, the elongate inflatable bladder having a shape generally corresponding to a surfboard, the elongate inflatable bladder having a front end, a rear end, and a pair of side edges extending between the front and rear ends, the inflatable bladder having a top surface and a bottom surface, the inflatable bladder having an elongate pocket extending along a longitudinal axis of the bladder between the front and rear ends, an elongate beam for stiffening the inflatable bladder when inflated, the elongate beam being removably insertable in the elongate pocket of the inflatable bladder;

a slit being formed in the bottom surface of the inflatable bladder and opening into the elongate pocket;

the elongate pocket dividing the interior of the inflatable bladder into two individual chambers, each chamber being adapted to hold air and not being in communication with the other of the chambers; and the pocket being adapted to close the slit upon inflation of the chambers of the inflatable bladder with the beam held in the pocket.

2. The collapsible surfboard system of claim 1, wherein the pocket divides the bladder into two sides of substantially equal size.

3. The collapsible surfboard system of claim 1, wherein each chamber being adapted to hold air independent of the other said chamber.

4. The collapsible surfboard system of claim 1, wherein the inflatable bladder has an air valve in communication with the interior of the inflatable bladder.

5. The collapsible surfboard system of claim 4, wherein the air valve is located on the rear end of the inflatable bladder.

6. The collapsible surfboard system of claim 4, wherein the bladder includes one air valve in communication with each of the chambers, and the two air valves are positioned at laterally spaced locations on the rear end of the inflatable bladder.

7. The collapsible surfboard system of claim 1, wherein the beam has an arcuate shape for creating a concave curve in the top surface of the inflatable bladder when the beam is inserted in the pocket of the bladder.

8. The collapsible surfboard system of claim 1, wherein the elongate beam has front and rear elongate portions being connectable in an end-to-end arrangement for insertion into the pocket of the inflatable bladder and being disconnectable for facilitating transport and storage of the beam when the bladder is not in use.

9. The collapsible surfboard system of claim 8, wherein the portions of the beam are connectable by a pair of support plates, each of the support plates being attachable to a side of the beam portions opposite of the side of the other of the support plates, a fastener being adapted for passing through one of the support plates, and end of one of the beam portions, and the other of the supports plates such that the beams portions are sandwiched between the support plates.

10. The collapsible surfboard system of claim 1, wherein the beam has an I-shape.

11. The collapsible surfboard system of claim 1, wherein the beam comprises aluminum.

12. The collapsible surfboard system of claim 1, further comprising at least one fin assembly, said at least one fin assembly comprising a fin mount formed in the bottom surface of the inflatable bladder, the fin mount having a slot therein, the fin assembly including a fin releasably insertable in the slot of the fin mount.

13. The collapsible surfboard system of claim 12, wherein three fin assemblies are mounted on the bottom surface of the inflatable bladder.

14. The collapsible surfboard system of claim 12, wherein the fin has an insertion portion for insertion into the slot of the fin mount.

15. The collapsible surfboard system of claim 14, wherein the insertion portion has a flange thereon for removably lodging in the slot of the fin mount.

16. The collapsible surfboard system of claim 1, further comprising a leash attachment grommet mounted on the top surface of the inflatable bladder.

* * * * *